United States Patent [19]

Guscott

[11] Patent Number: 4,999,610

[45] Date of Patent: Mar. 12, 1991

[54] MULTI-RANGE INFRARED DETECTOR

[75] Inventor: John K. Guscott, Stow, Mass.

[73] Assignee: Aritech Corporation, Framingham, Mass.

[21] Appl. No.: 441,173

[22] Filed: Nov. 27, 1989

[51] Int. Cl.[5] ..... G08B 13/18

[52] U.S. Cl. ..... 340/567; 250/342; 250/349

[58] Field of Search ..... 340/567; 250/342, 349

[56] References Cited

U.S. PATENT DOCUMENTS

| | | | |
|---|---|---|---|
| 3,928,843 | 12/1975 | Sprout et al. | 340/567 |
| 4,542,295 | 9/1985 | Mattson et al. | 250/349 |
| 4,618,854 | 10/1986 | Miyake et al. | 340/567 |
| 4,906,976 | 3/1990 | Guscott | 340/567 |

*Primary Examiner*—Glen R. Swann, III

*Attorney, Agent, or Firm*—Weingarten, Schurgin, Gagnebin & Hayes

[57] ABSTRACT

An infrared detection system having a detector which includes elements of different sizes which are electrically selectable to change the operational range of the system without any change in the associated optical assembly. The detector elements can be of two or more element sizes, and various detector configurations can be employed such as single or dual detector configurations. To provide a constant signal amplitude for the different selected ranges, the gain of the detector circuitry can be adjusted accordingly to provide uniform signal amplitude irrespective of range setting.

6 Claims, 2 Drawing Sheets

MULTI-RANGE INFRARED DETECTOR

FIELD OF THE INVENTION

This invention relates to infrared detection systems for intrusion detection and more particularly to a detector for multiple range operation.

BACKGROUND OF THE INVENTION

Passive infrared detection systems are known for the detection of intruder presence in a protected area, and in general include a detector, and an optical assembly for focusing infrared radiation onto the detector, and electronic signal processing circuitry for providing an output indication of intruder detection when predetermined threshold conditions have been met.

The range of the infrared detection system is determined by the size of the detector element and the focal length of the optics, the maximum range being defined as that beyond which the optical image of an intruder or other detectable object does not fill the area of the detector element. Up to the maximum range, the radiation received by the detector is constant because the change in the received radiation is offset by the change in image area thereby resulting in substantially constant detector sensitivity with range, up to the maximum range of the system. Beyond the defined maximum range, the sensitivity will decrease in conformance with the inverse square law which provides that the intensity of radiation decreases in proportion to the square of the distance from its source.

Detection systems of known construction are usually designed for an intended range. For installations where there are different range requirements, systems designed for the respective ranges must be separately constructed and provided.

SUMMARY OF THE INVENTION

In brief, the present invention, provides an infrared detection system having a detector which includes elements of different sizes which are electrically selectable to change the operational range of the system without any change in the associated optical assembly The detector elements can be of two or more element sizes, and various detector configurations can be employed such as single or dual detector configurations. To provide a constant signal amplitude for the different selected ranges, the gain of the detector circuitry can be adjusted accordingly to provide uniform signal amplitude irrespective of range setting.

DESCRIPTION OF THE DRAWING

The invention will be more fully understood from the following detailed description read in conjunction with the accompanying drawing in which.

DETAILED DESCRIPTION OF THE INVENTION

Figure 1:
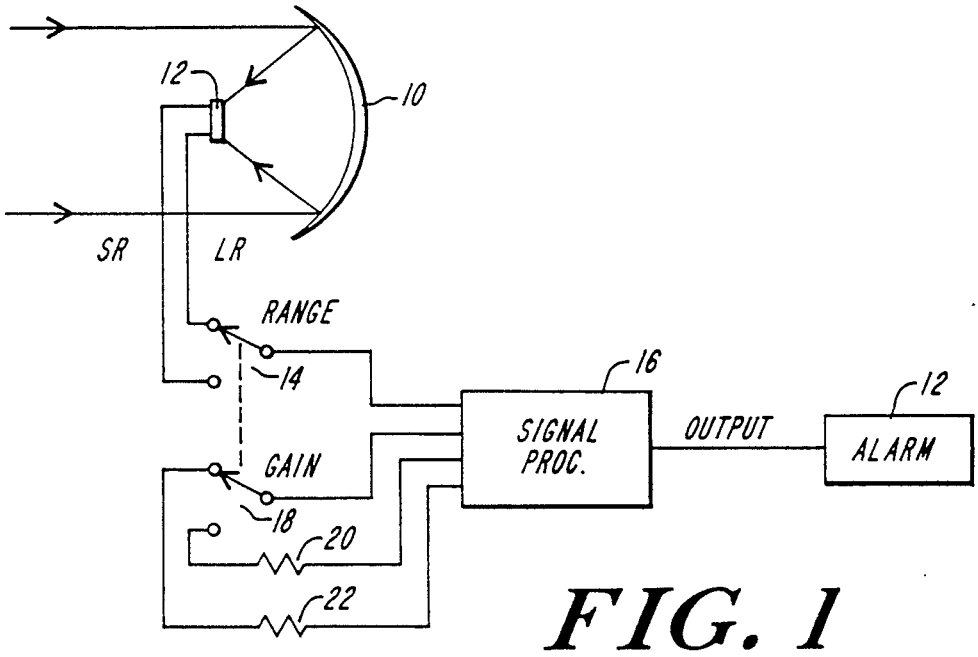
FIG. 1 is a diagrammatic representation of an infrared detection system in accordance with the invention.

Referring to FIG. 1 there is shown an infrared detection system in accordance with the invention which includes an optical system 10 having a common focal length and at the focal position of which is disposed a detector 12, to be described below, having multiple outputs coupled via a range selector switch 14 to a signal processor 16. A gain compensation switch 18 is ganged to the range selector switch 14 and selectively couples gain compensation elements such as resistors 20 and 22 to the signal processor. The signal processor 16 provides an output signal indicative of intruder detection which can be employed to energize a suitable output device such as an audible or visual alarm, 17 on an automatic dialing device or other apparatus responsive to provide an output indication of intruder detection. The signal processor 16 can itself be of construction and operation known in the art and having circuitry for comparing the detector signal with one or more reference signals or signal conditions to provide an output signal if the detection criteria has been met.

The detector 12 according to the invention includes detector elements of different sizes corresponding to respective ranges for a multi-range system, and separate output signals are provided by the detector each associated with a respective range. The multiple outputs of the detector are coupled to the range selector switch 14 which can be manually or otherwise set to an intended range setting for coupling of the output of the selected elements of the detector to the signal processor. In the illustrated embodiment two ranges are shown, a long range (LR) and a short range (SR). It is contemplated that more than two ranges can be provided and the invention is not to be limited to only a dual range system. The long range elements are smaller than the short range elements and thus the signal amplitude from the detector will be different for each range setting. The signal amplitude from the detector is a function of the irradiance of received energy, the responsivity of the detector element and the element area. The signal amplitudes can be compensated to provide uniform amplitude for all range settings by adjusting the gain of the signal processor amplifier such as by the illustrated technique of compensation resistors 20 and 22 which can be selectively switched into the circuit in accordance with the range selector setting. If a detector is employed with buffer amplifiers, the gain of the buffer amplifiers can be adjusted to provide gain compensation.

Figure 2:
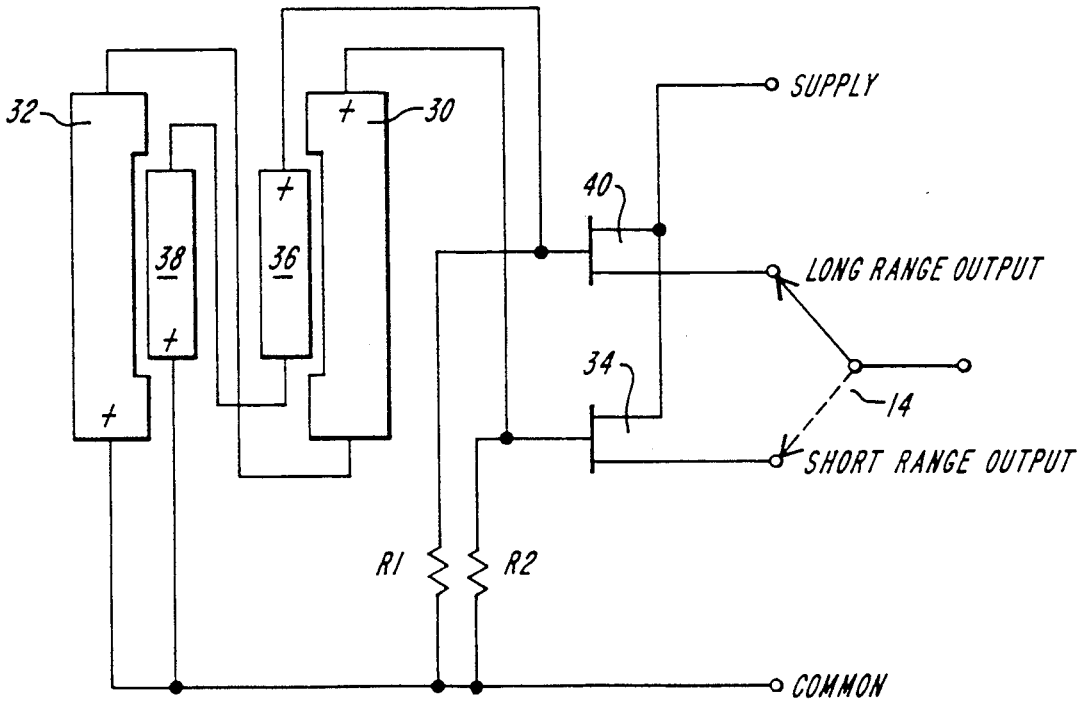
FIG. 2 is a diagrammatic representation of a single dual range detector of the invention.

A single dual range detector is illustrated in FIG. 2. A pair of larger detector elements 30 and 32 are connected as shown in phase opposition between a common terminal and an electronic switch such as FET switch 34. A pair of smaller detector elements 36 and 38 are connected as illustrated in phase opposition between the common terminal and a second electronic switch such as FET switch 40. The larger elements 30 and 32 serve as the short range elements, while the smaller elements 36 and 38 serve as the long range elements. The switches 34 and 40 are coupled to the range selector switch 14 for selection of the long and short range respectively. The FET switches are also coupled to a suitable power source. Resistors R1 and R2 provide appropriate biasing of the FET switches.

Figure 3:
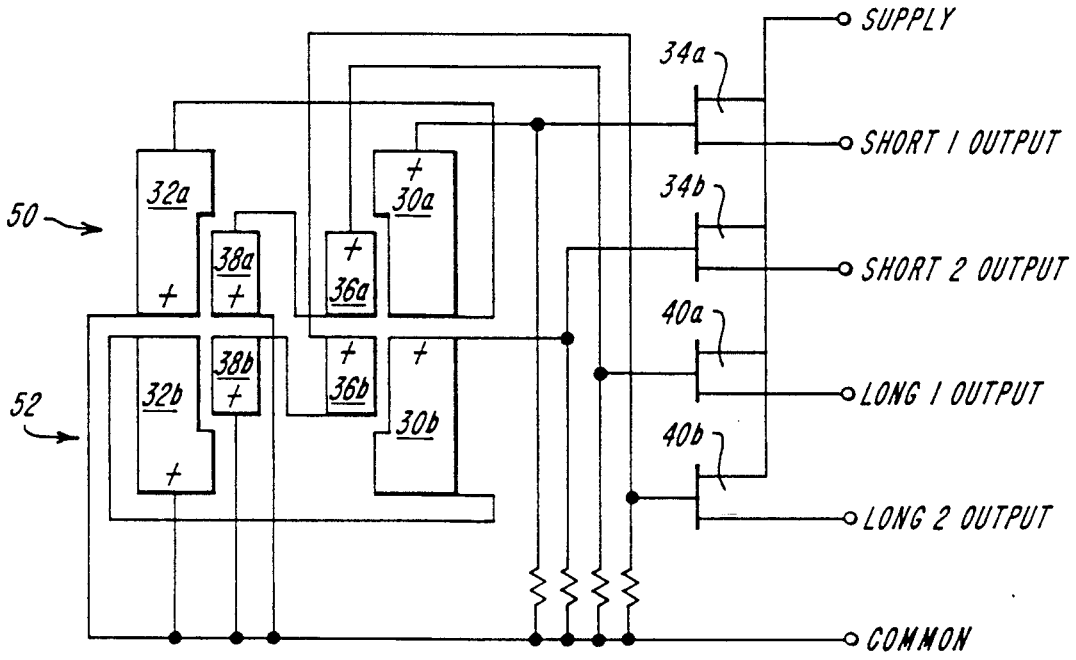
FIG. 3 is a diagrammatic representation of a double dual range detector of the invention.

A double dual range detector is shown in FIG. 3. The elements are arranged in two identical groups 50 and 52. The group 50 includes longer elements 30*a* and 32*a* connected as shown between the common terminal and switch 34*a*, and smaller elements 36*a* and 38*a* connected between the common terminal and switch 40*a*. The group 52 is composed of the elements 30*b*, 32*b*, 36*b* and 38*b* connected to switches 34*b* and 40*b*. The elements 30*a* and 32*a* are short range elements and provide a first short range output. The elements 30*b* and 32*b* provide a second short range output. The elements 36*a* and 38*a* provide a first long range output. The second long range output is provided by elements 36*b* and 38*b*. This double, dual range detector, functions in essentially the same manner as the dual range detector of FIG. 2 except that it effectively provides four selectable ranges of detection; two different short range modes of detection and two different long range modes of detection. The double, dual range detector of FIG. 2 requires the capability of a switching mechanism to provide one of four selectable ranges to the signal processor.

While the embodiments disclosed herein illustrate the use of FETS to gate signals from the various range detectors to mechanical switches, other gating devices and switching methods such as monolithic semiconductor analog switches and multiplexors could be used. Likewise, multiple range detectors, according to the invention, embodying a plurality of range detectors in excess of eight may also be configured.

Although the invention has been shown and described with respect to exemplary embodiments thereof, it should be understood by those skilled in the art that the foregoing and various other changes, omissions and additions in the form and detail thereof may be made therein without departing from the spirit and scope of the invention.

I claim:

1. A multi-range passive infrared intrusion detection system comprising:

a detector having a first detector element of a first size and a second detector element of a second size different from the first size;

the detector elements being operative to produce electrical signals in response to infrared energy impinging thereon;

an optical assembly for focusing infrared energy onto the detector elements;

a signal processor operative in response to electrical signals from the detector to provide an output indication of intruder detection; and electrical selection means coupled to the first and second elements of the detector and operative to selectively connect either of the first and second elements to the signal processor to thereby change the operative range of the system.

2. The system of claim 1 including means cooperative with the signal processor for adjusting the gain of the signal processor to provide substantially uniform amplitude detector signals for all range settings of the electrical selection means.

3. The system of claim 1 including means operative to provide substantially uniform amplitude of the electrical signals from the detector irresPective of the setting of the electrical selection means.

4. A multi-range passive infrared intrusion detection system comprising:

a detector having a plurality of detector elements, at least one of said plurality of detector elements being of a different size than others of said plurality of detector elements, said detector elements being operative to produce electrical signals in response to infrared energy impinging thereon;

an optical assembly for focusing infrared energy onto said plurality of detector elements;

a signal processor operative in response to electrical signals from said plurality of detector elements; and selection means coupled to said plurality of detector elements and operative to selectively connect at least one of said plurality of detector elements to said signal processor to thereby change the operative range of said system.

5. The system of claim 4 further comprising:

means cooperative with said signal processor for adjusting the gain of said signal processor to provide substantially uniform amplitude detector signals for all range settings of said electrical selection means.

6. The system of claim 4 further comprising:

means operative to provide substantially uniform amplitude of electrical signals from said detector irrespective of the setting of said selection means.

* * * * *